US009599425B2

(12) United States Patent
Barnett

(10) Patent No.: US 9,599,425 B2
(45) Date of Patent: Mar. 21, 2017

(54) CROSSBOW WITH COCKING DEVICE STORAGE AND METHOD

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 15/226,434

(22) Filed: Aug. 2, 2016

(65) Prior Publication Data

US 2017/0038175 A1 Feb. 9, 2017

Related U.S. Application Data

(60) Provisional application No. 62/202,618, filed on Aug. 7, 2015.

(51) Int. Cl.
*F41B 5/12* (2006.01)
*F41B 5/14* (2006.01)

(52) U.S. Cl.
CPC ..... *F41B 5/1403* (2013.01); *F41B 5/12* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 7,100,590 | B2 * | 9/2006 | Chang | F41B 5/1469 124/25 |
| 8,443,790 | B2 * | 5/2013 | Pestrue | F41B 5/12 124/25 |
| 8,453,631 | B1 * | 6/2013 | Kronengold | F41A 11/02 124/25 |
| 8,578,917 | B2 * | 11/2013 | Bednar | F41B 5/1469 124/25 |
| 9,404,706 | B2 * | 8/2016 | Khoshnood | F41B 5/1469 |
| 2010/0170488 | A1 * | 7/2010 | Rasor | F41A 11/02 124/25 |
| 2013/0298890 | A1 * | 11/2013 | Bednar | F41B 5/123 124/25 |
| 2013/0305579 | A1 | 11/2013 | Ward et al. | |

OTHER PUBLICATIONS

U.S. Appl. No. 14/589,589, Inventor: David A. Barnett, Applicant: Barnett Outdoors, LLC, filed Jan. 5, 2015 (co-pending application).

* cited by examiner

*Primary Examiner* — John Ricci
(74) *Attorney, Agent, or Firm* — Jones Walker LLP

(57) ABSTRACT

A crossbow including a receptacle in a side of the crossbow's stock configured to receive a portion of a cocking device in a storage position, and a bore through a rear portion of the stock configured to receive a spool of the cocking device. A cover is pivotally connected to the rear portion of the stock. When closed, the cover blocks access to the bore. In a cocking position, the spool of the cocking device is rotatably disposed within the bore.

26 Claims, 11 Drawing Sheets

CROSSBOW WITH COCKING DEVICE STORAGE AND METHOD

CROSS REFERENCE TO RELATED APPLICATION

This application claims the benefit of and priority to U.S. Provisional Patent Application No. 62/202,618, filed on Aug. 7, 2015, which is incorporated by reference herein in its entirety.

BACKGROUND OF THE INVENTION

Crossbow cocking devices are used to cock crossbows with reduced effort. A user must transport the components of the cocking device along with the crossbow and other hunting gear in order to use the cocking device while hunting. There is a need for efficient storage solutions for the components of a cocking device used with crossbows.

DETAILED DESCRIPTION OF THE PREFERRED EMBODIMENTS

A crossbow disclosed herein may include one or more receptacles in a side of the crossbow's stock configured to receive a portion of a cocking device, and a bore through a rear portion of the stock configured to receive a spool of the cocking device. The crossbow stock may also include a cover pivotally connected to the rear portion of the stock. When closed, the cover may block access to the bore. In a storage position, a component of the cocking device may be secured to the receptacle. In a cocking position, the spool of the cocking device may be rotatably disposed within the bore.

Figure 1:
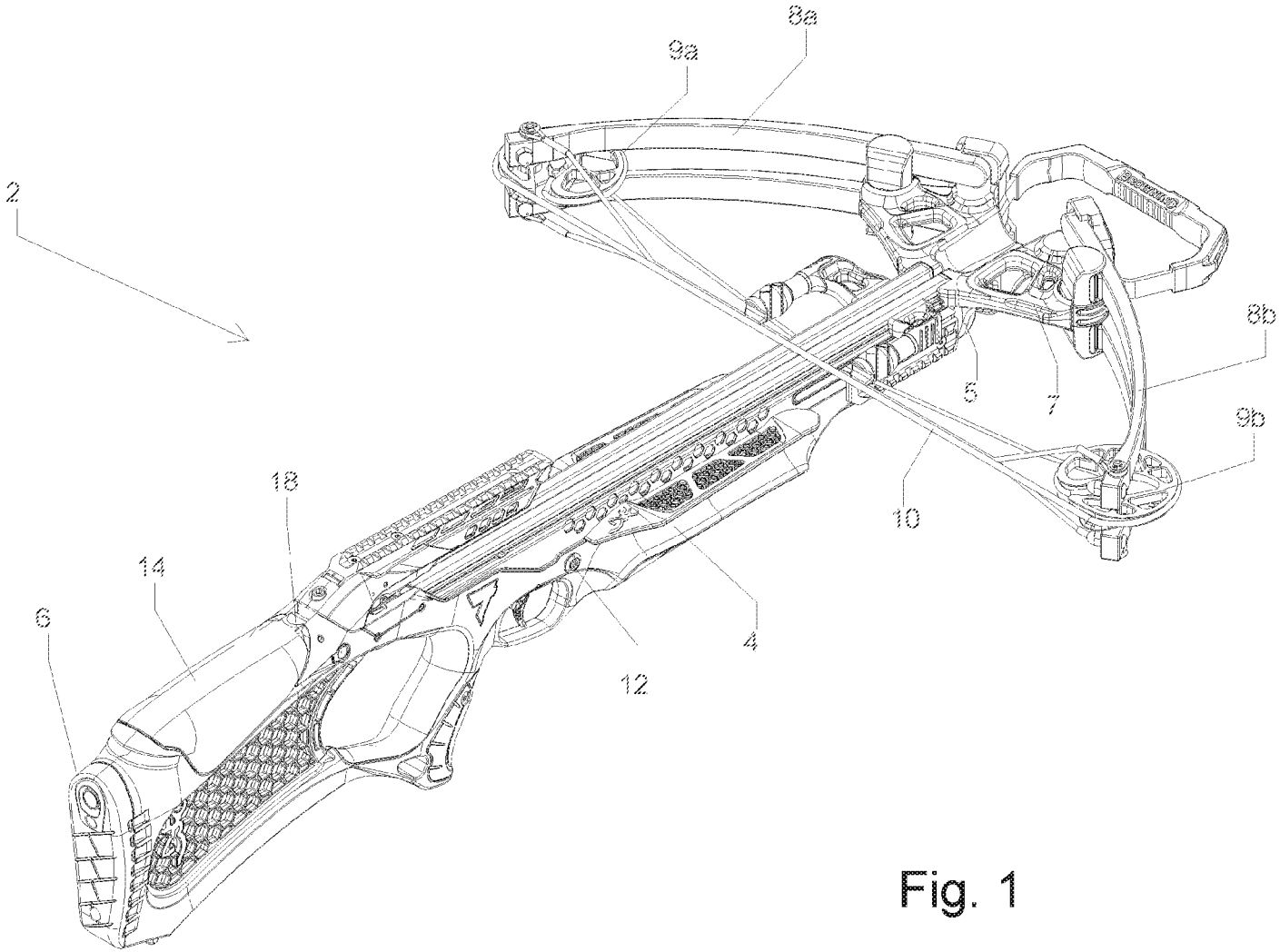
FIG. 1 is a perspective view of a crossbow with storage for a cocking device.

FIG. 1 illustrates one embodiment of a crossbow with storage for a cocking device. Crossbow 2 includes stock 4 extending from front portion 5 to rear portion 6. Crossbow

2 may also include a riser assembly operatively mounted to front portion 5 of stock 4. The riser assembly may include riser 7 mounted to front portion 5, bow limbs 8*a* and 8*b* having proximal ends mounted to riser 7, cams 9*a* and 9*b* mounted to distal ends of bow limbs 8*a* and 8*b*, respectively, and bow string 10 engaging cams 9*a* and 9*b*. Alternatively, crossbow 2 may be a recurve crossbow including no cams.

Crossbow 2 may include receptacle member 12 in a side of stock 4. A second receptacle member 12 may be disposed in the other side of stock 4. Alternatively, crossbow stock 4 may only include a single receptacle member 12 in one side. Stock 4 may also include cover 14 near rear portion 6 of crossbow stock 4. Cover 14 may form a cheek piece of crossbow stock 4. Cover 14 may open by pivoting about pivot point 18.

Figure 2:
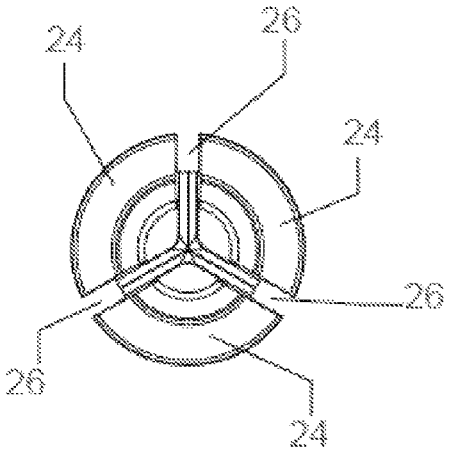
FIG. 2 is a front view of a receptacle member of the crossbow.
Figure 3:
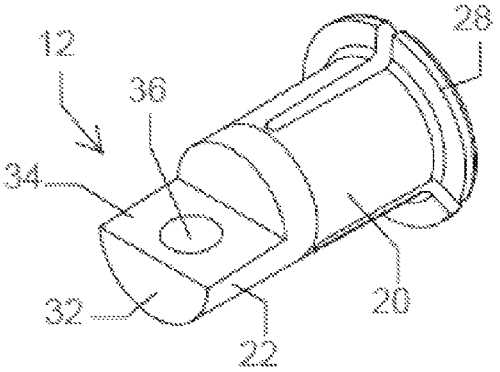
FIG. 3 is a rear perspective view of the receptacle member.
Figure 4:
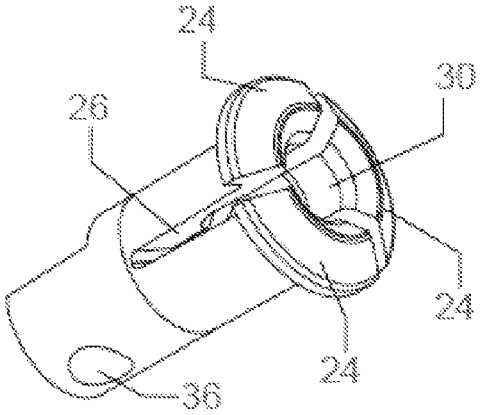
FIG. 4 is a front perspective view of the receptacle member.

FIGS. 2-4 illustrate receptacle member 12 separated from crossbow stock 4. Receptacle member 12 may include receptacle portion 20 and connection portion 22. Receptacle portion 20 may include two or more expanding members 24 separated by longitudinal gaps 26. Receptacle portion 20 may have a generally cylindrical shape with shoulder 28 at its distal end. The distal ends of expanding members 24 may form shoulder 28. In an alternate embodiment, receptacle portion 20 may have another shape (e.g., square, oval, triangular, hexagonal, etc.). The internal surfaces of expanding members 24 may form central cavity 30. Central cavity 30 may be dimensioned to receive a portion of a hook member of a crossbow cocking device. Expanding members 24 may expand to allow insertion of a portion of the hook member into central cavity 30. Connection portion 22 of receptacle member 12 may include key 32 having a flat surface 34 with bore 36 extending therethrough.

Figure 5:
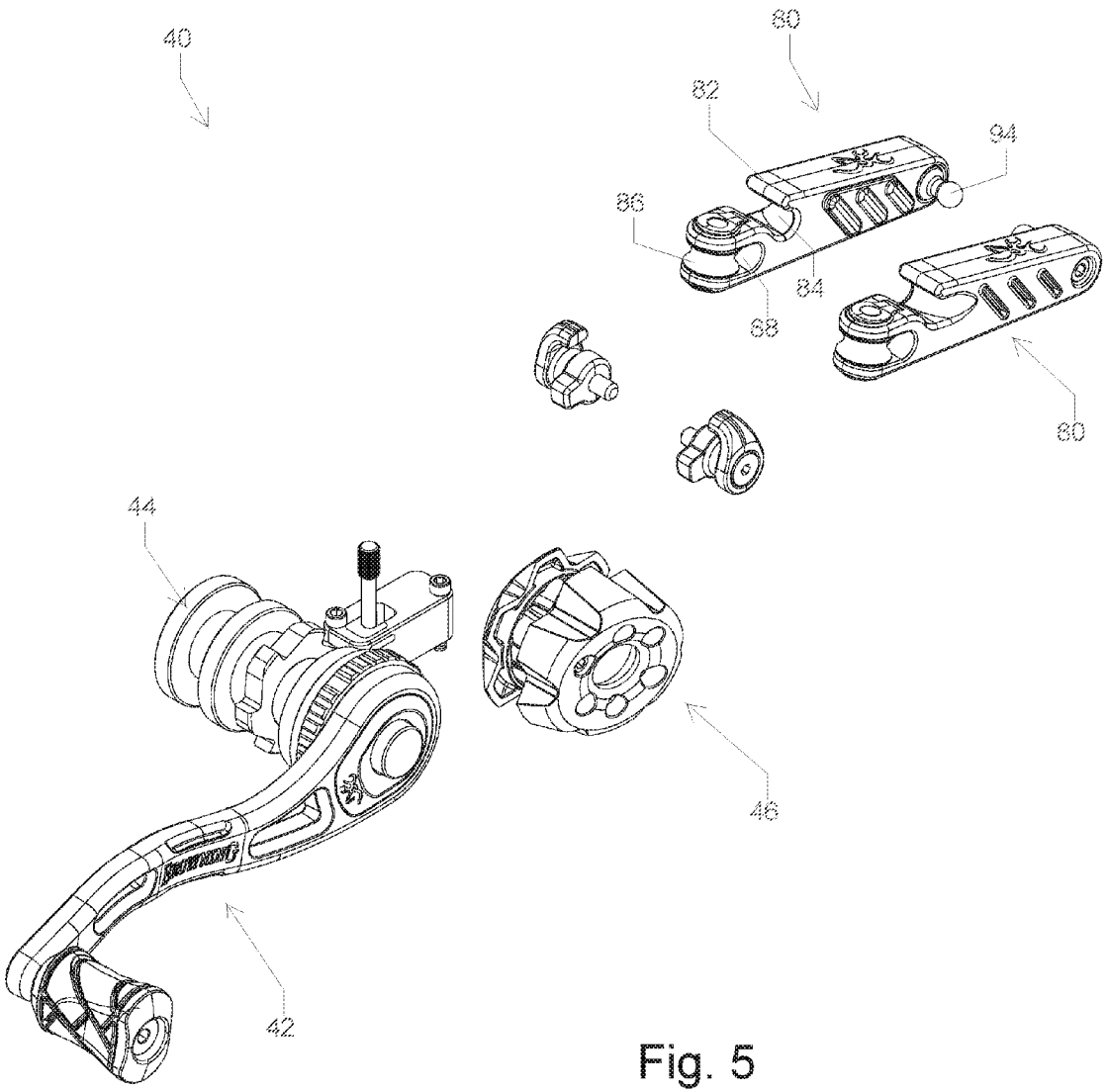
FIG. 5 is a perspective view of a cocking device for use with the crossbow.
Figure 6:
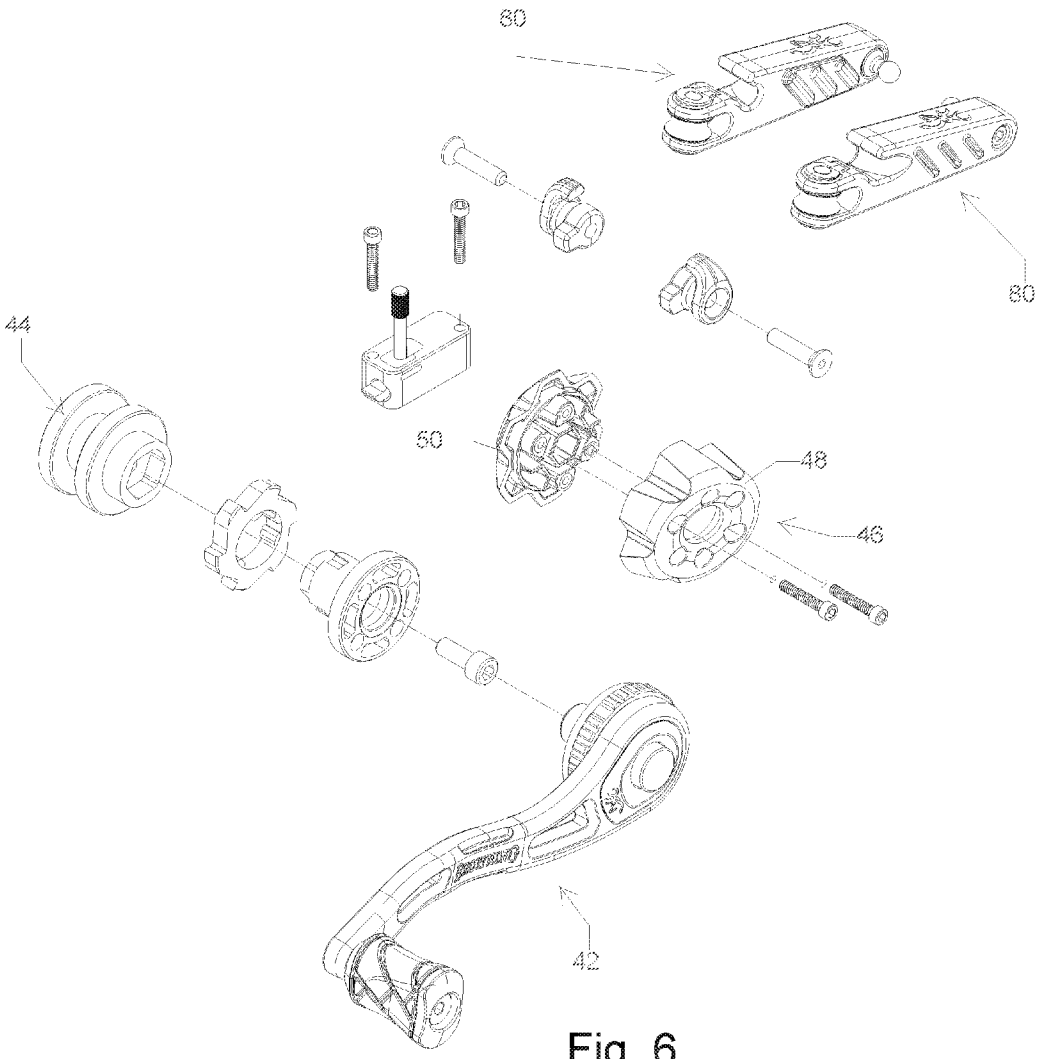
FIG. 6 is an exploded view of the cocking device shown in FIG. 5.

FIGS. 5 and 6 illustrate crossbow cocking device 40 including handle 42 and spool member 44. Handle receptacle 46 is also illustrated. Handle receptacle 46 is configured to attach to stock 4 and to receive handle 42 for storage on stock 4. Handle receptacle 46 may include shell members 48 and 50. Crossbow cocking device 40 may further include hook member 80, which is configured to engage receptacle member 12. Hook member 80 may include hook 82 and hook surface 84 for engaging a string of a crossbow being cocked. Hook 80 may also include rope spool surface 86 enclosing aperture 88. A rope of the crossbow cocking device may be disposed through aperture 88. The rope may slide along rope spool surface 86 as hook members 80 are drawn rearwardly along the crossbow in order to pull the crossbow string into a cocked position with hook 82.

Figure 7:
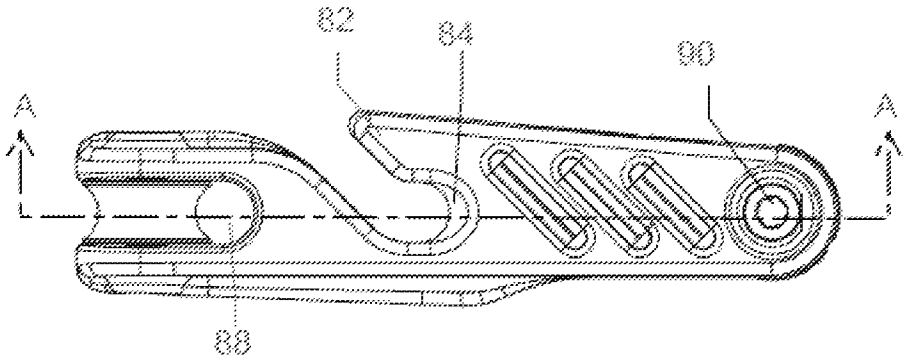
FIG. 7 is a side view of a handle member of the cocking device shown in FIG. 5.
Figure 8:
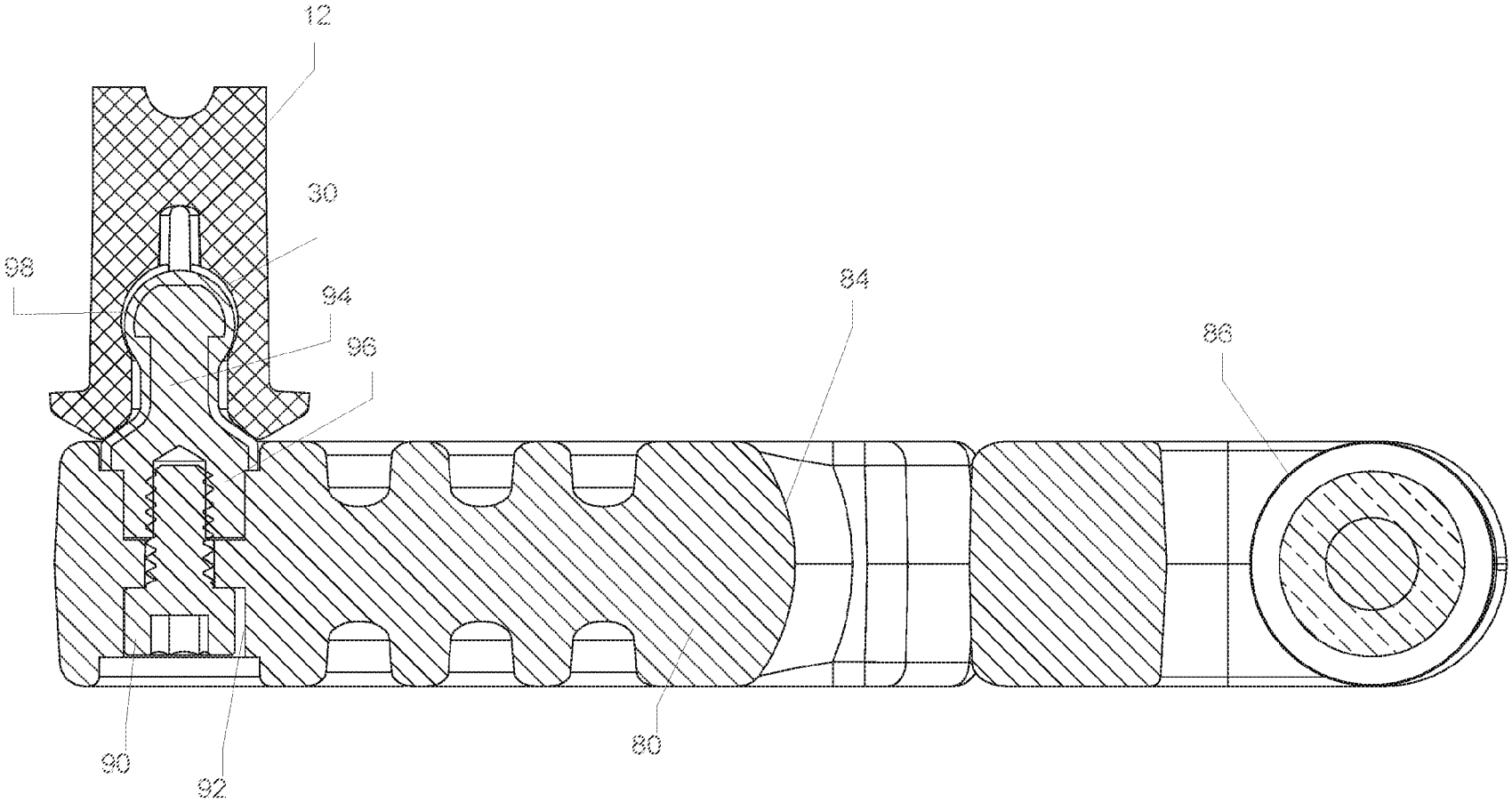
FIG. 8 is a sectional view of the handle member engaging the receptacle member taken from line A-A in FIG. 7.

Referring now to FIGS. 7 and 8, hook member 80 also includes fastener 90 disposed in recess 92 for connecting plug 94 to hook member 80. In one embodiment, fastener 90 and plug 94 each includes a threaded surface for threadedly engaging one another. Alternate fastener mechanisms known in the art may be employed without departing from the spirit of the invention. Plug 94 may include proximate end 96 configured for attachment to fastener 90, and distal end 98 configured to engage central cavity 30 of receptacle member 12. Proximate end 96 may be completely or partially disposed within recess 92 of hook member 80. Distal end 98 may have a shape that is reciprocal to the shape of central cavity 30 of receptacle member 12. In one embodiment, distal end 98 and central cavity 30 may each include a restricted portion extending to an expanded portion. The expanded portion of distal end 98 may be retained within central cavity 30 and the restricted portion of central cavity 30 may engage the restricted portion of distal end 98, thereby blocking distal end 98 from sliding out of central cavity 30. In this way, distal end 98 of plug 94 may engage central cavity 30 in order to attach hook 80 to receptacle member 12. With receptacle member 12 affixed to the side of crossbow stock 4, hook member 80 may be affixed to crossbow stock 4 by inserting distal end 98 of plug 94 into central cavity 30 of receptacle member 12.

Figure 9:
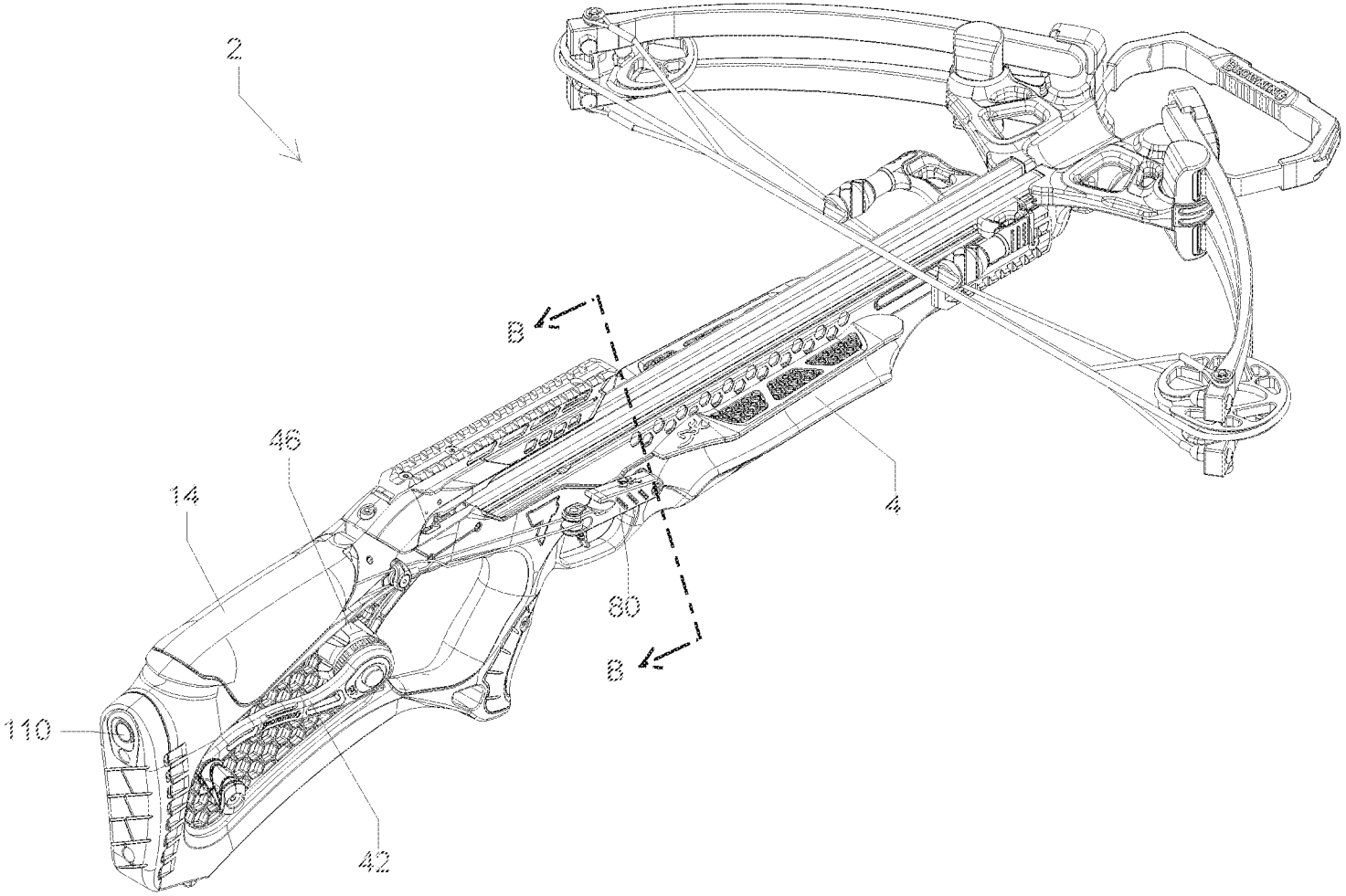
FIG. 9 is a perspective view of the crossbow with the cocking device in the storage position.
Figure 10:
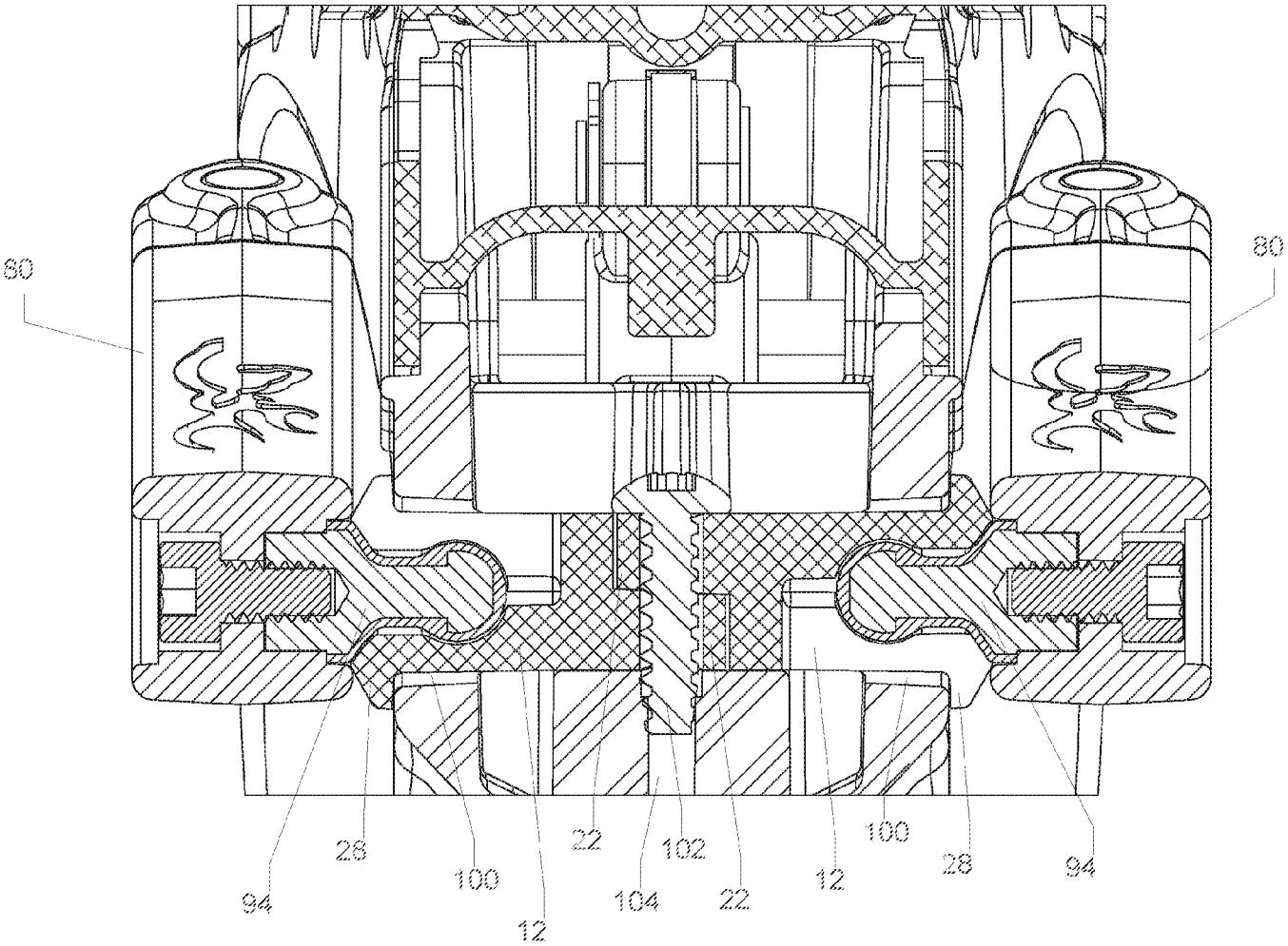
FIG. 10 is a partial sectional view of a plug of the handle member engaging the receptacle member of the crossbow in the storage position taken from line B-B in FIG. 9.

FIGS. 9 and 10 illustrate crossbow 2 in a storage position. Hook members 80 are attached to receptacle members 12 in each side of crossbow stock 4. Each receptacle member 12 may be housed within recess 100 in each side surface of crossbow stock 4. Connection portion 22 and the cylindrical portion of receptacle portion 20 may be inserted into recess 100. In one embodiment, recess 100 extends entirely through the width of crossbow stock 4. In this embodiment, keys 32 of the two receptacle members 12 may overlap one another such that flat surface 34 of the first receptacle member 12 engages flat surface 34 of the second receptacle member 12. Fastener 102 may be secured through bore 36 of each receptacle member 12 to secure receptacle members 12 within recess 100. Fastener 102 may be a screw, a bolt, a pin, or any other suitable fastening device known in the art. Fastener 102 may further extend through bore 104 within crossbow stock 4. Shoulder 28 at distal end of each receptacle member 12 may engage the outer surface of the crossbow stock 4. Alternatively, a recess or bore of crossbow stock 4 may include a distal recess for housing shoulder 28 of receptacle member 12 such that shoulder 28 does not extend beyond the outer surface of the crossbow stock 4. In another alternate embodiment, receptacle member 12 may include no shoulder 28. In the storage position, handle 42 may secured to stock 4 with handle receptacle 46 for storage of handle 42 in the storage position.

Figure 11:
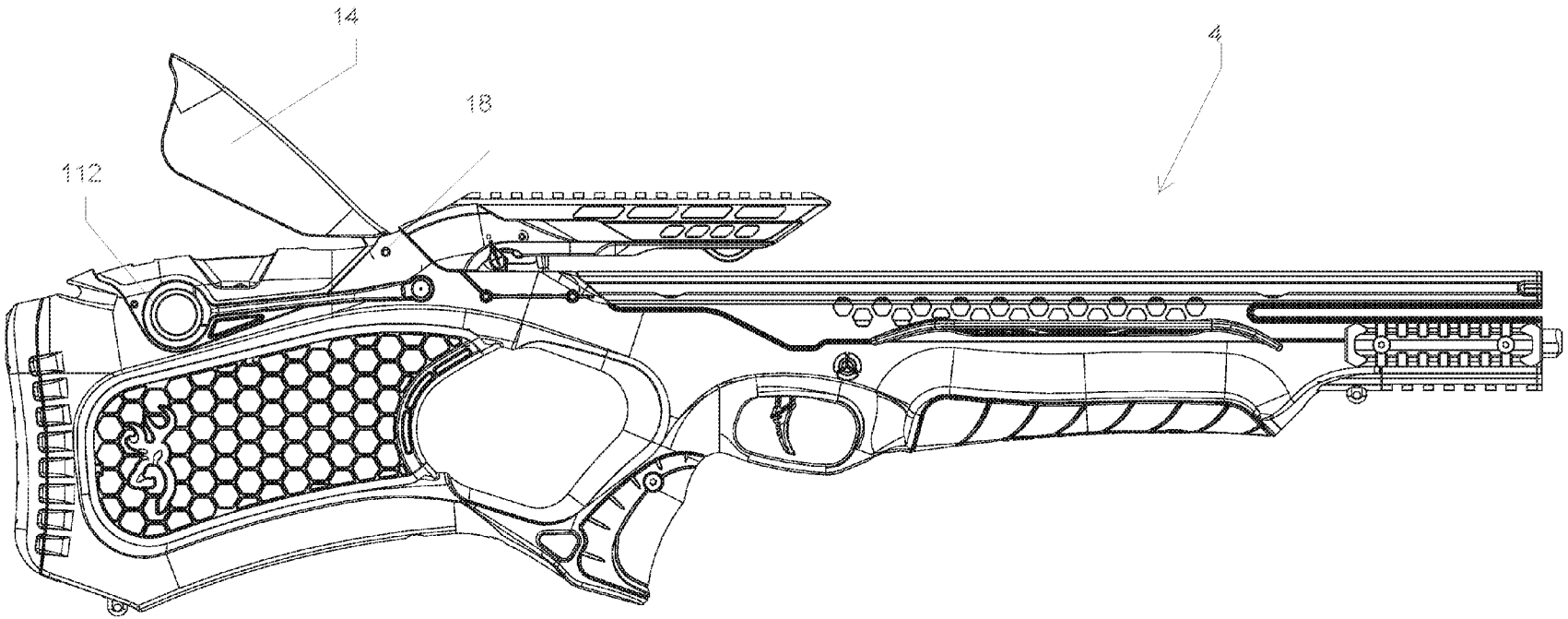
FIG. 11 is a side view of a stock of the crossbow with a cover in an open position.
Figure 12:
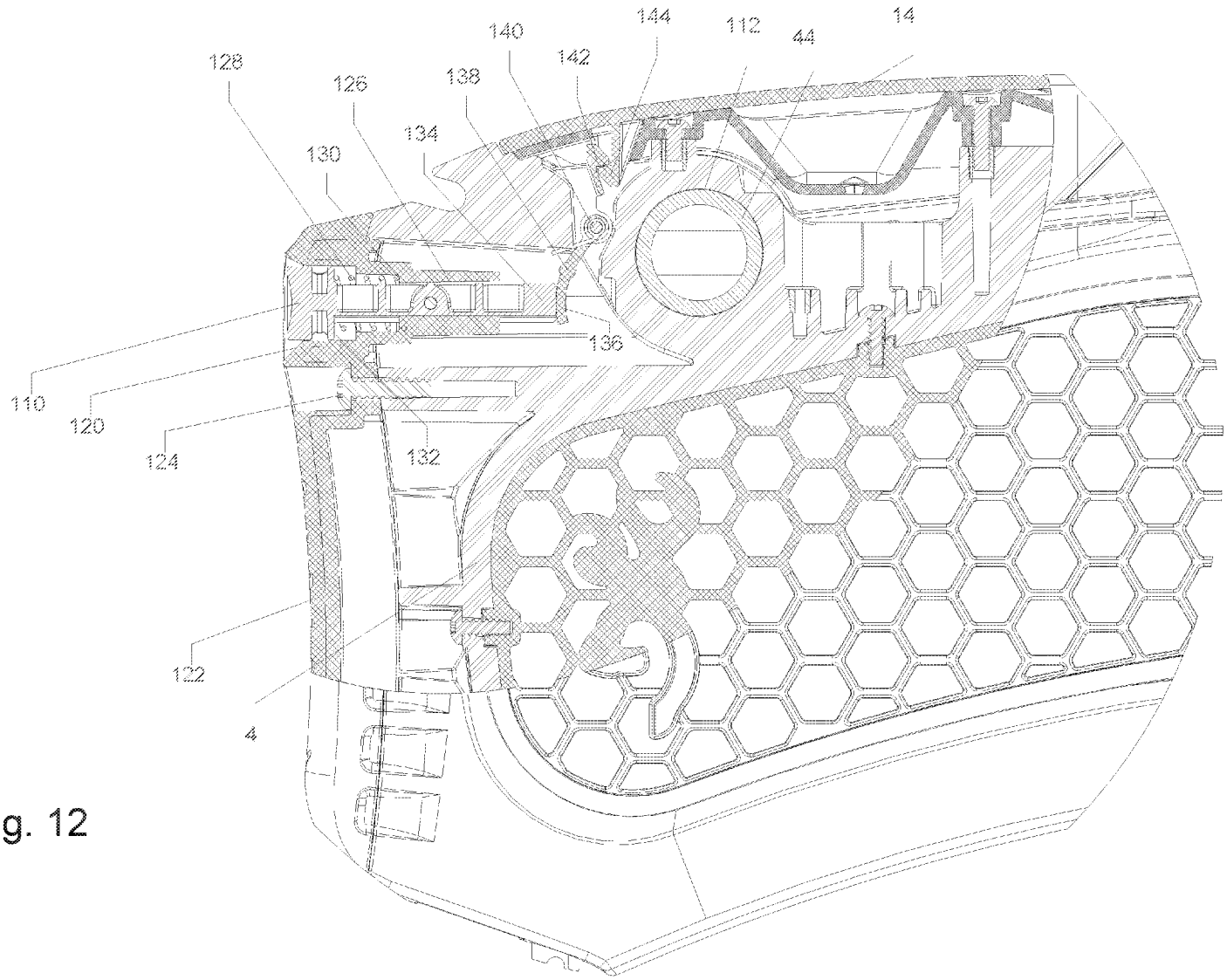
FIG. 12 is a partial sectional view of a rear portion of the crossbow stock.

With reference to FIGS. 11 and 12, crossbow stock 4 may include control 110 (also shown in FIG. 9) near rear portion 6. Actuation of control 110 may cause cover 14 to pivot from the closed position shown in FIG. 9 to the open position shown in FIG. 11. Opening cover 14 may expose spool bore 112 of crossbow stock 4. Spool bore 112 may be configured to receive spool member 44 of cocking device 40. In one embodiment, a spool bushing may be disposed within spool bore 112 to facilitate rotation of spool member 44 within spool bore 112. Spool member 44 may be positioned within spool bore 112 in the storage position and in the cocking position. Control 110 may be formed of a push button disposed through or within aperture 120 of butt plate 122. Butt plate 122 may be affixed to crossbow stock 4 with one or more fastening members 124. Button housing 126 may be disposed within crossbow stock 4 for receiving control 110. Spring 128 may be disposed between and bias shoulder 130 of button housing 126 against shoulder 132 of control 110. Distal end 134 of control 110 may engage first end 136 of catch member 138, which may also include pivot point 140 and second end 142. Second end 142 of catch member 138 may engage latch 144 of cover 14. Second end 142 of catch member 138 and latch 144 may each include a reciprocal shoulder for engaging the two components. Alternate engaging mechanisms known in the art may be employed for second end 142 and latch 144 without departing from the spirit of the invention.

Applying an inward force on control 110 compresses spring 128 and displaces first end 136 of catch member 138, thereby rotating catch member 138 around pivot point 140. The pivoting of catch member 138 causes second end 142 of catch member 138 to disengage from latch 144 of cover 14, which allows cover 14 to open. In this way, actuation of control 110 opens cover 14. Once the inward force is removed from control 110, spring 128 forces control 110 into its original position, which allows catch member 138 to return to its original position.

Figure 13:
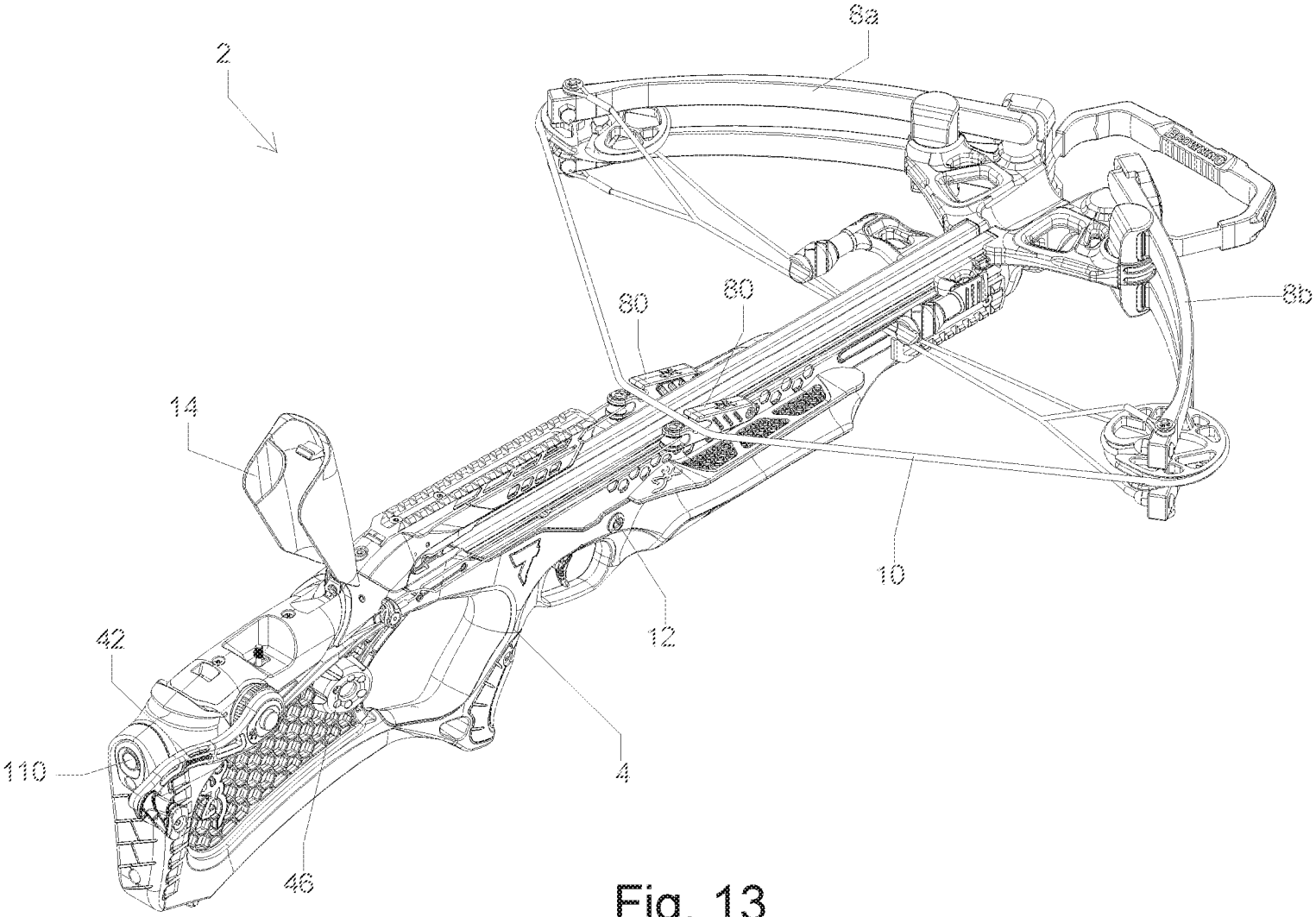
FIG. 13 is a perspective view of the crossbow with the cocking device in the cocking position.

Referring now to FIG. 13, handle 42 of crossbow cocking device 40 may be connected to spool member 44 disposed through spool bore 112 with cover 14 in the open position. Rotation of handle 42 will rotate spool member 44, which may wind or unwind a rope or cable connected between spool member 44 and hook members 80. During use hook members 80 are not attached to receptacle members 12. In one embodiment, plug 94 may be positioned within and slide along a track of the crossbow stock during use. Alternatively, hook members 80 may be detached from crossbow stock 4 during use. With hook members 80 engaging bow string 10, rotation of handle 42 winds rope or cable of cocking device 40 to draw hook members 80 (one on either side of crossbow stock 4) and bow string 10 rearwardly along with the crossbow string in order to cock the crossbow.

Upon completion of using the crossbow cocking device (e.g., when the crossbow string is secured in the cocked position such as with a trigger catch), the handle may be disconnected from spool member 44 and cover 14 may be closed by engaging latch 144 of cover 14 with second end 142 of catch member 138. Hook members 80 may be stored on crossbow stock 4 by placing plug 94 in center cavity 30 of receptacle member 12. In one embodiment, a receptacle may be included on crossbow stock 4 for the handle of the crossbow cocking device. For example, handle receptacle 46 may be positioned near rear portion 6 of crossbow stock 4. Accordingly, crossbow stock 4 disclosed herein may be used to store components of a crossbow cocking device during transportation or use of the crossbow.

In one alternate embodiment, crossbow stock 4 may include receptacle member 12 without cover 14, control 110, or spool bore 112. In another alternate embodiment, crossbow stock 4 may include cover 14, control 110, and spool bore 112 without receptacle member 12. Each of these alternatives provides advantages over prior art crossbows by allowing a user to either store components of a crossbow cocking device when not in use or to conveniently cover spool bore 112 when not in use.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A crossbow stock comprising:

a receptacle in a first side of the crossbow stock, the receptacle including a central cavity configured to receive a portion of a cocking device in a storage position;

a bore through a rear portion of the crossbow stock, the bore configured to receive a spool member of a cocking device in a cocking position; and a cover pivotally attached to the rear portion of the crossbow stock, wherein the cover pivots between a closed position and an open position, wherein in the closed position the cover prevents access to the bore.

2. The crossbow stock of claim 1, wherein the receptacle includes a recess in an outer surface of the crossbow stock, and wherein the crossbow stock further comprises a receptacle member at least partially disposed within the recess, the receptacle member including two or more expanding members separated by an equal number of longitudinal gaps, wherein an internal surface of each of the expanding members defines the central cavity.

3. The crossbow stock of claim 2, wherein the receptacle member includes a shoulder that engages the outer surface of the crossbow stock.

4. The crossbow stock of claim 3, wherein the receptacle member includes a key portion having a lateral bore, and wherein a fastener is disposed through the lateral bore to secure the receptacle member in the recess of the crossbow stock.

5. The crossbow stock of claim 4, wherein the recess extends from the first side to a second side of the crossbow stock, and wherein the crossbow stock further comprises a second receptacle member including a key portion having a lateral bore, wherein the second receptacle member is at least partially disposed within the recess with the fastener disposed through the lateral bore of the second receptacle member to secure the second receptacle member in the recess.

6. The crossbow stock of claim 1, further comprising a control attached to the rear portion of the crossbow stock, wherein actuation of the control transfers the cover from the closed position into the open position.

7. The crossbow stock of claim 6, further comprising a catch member pivotally mounted within the rear portion of the crossbow stock, the catch member operatively engaging the control, wherein the cover includes a latch engaging the catch member in the closed position, and wherein actuation of the control releases the latch from the catch member to transfer the cover from the closed position into the open position.

8. The crossbow stock of claim 7, wherein the catch member includes a first end, a second end, and a pivot point between the first and second ends, wherein the catch member rotates about the pivot point, wherein an inner end of the control engages the first end of the catch member and the second end of the catch member engages the latch in the closed position.

9. The crossbow stock of claim 8, wherein the second end of the catch member includes a shoulder, and wherein the latch includes a reciprocal shoulder engaging the shoulder of the second end of the catch member in the closed position.

10. The crossbow stock of claim 6, wherein the control is disposed within an aperture through a butt plate of the crossbow stock.

11. The crossbow stock of claim 10, wherein the control comprises a push button biased by a spring.

12. A crossbow comprising:

a stock extending from a front portion to a rear portion, the stock including a bore through the rear portion and a receptacle in a first side surface of the stock between the front portion and the rear portion, wherein the receptacle includes a central cavity configured to receive a portion of a cocking device in a storage position, wherein the bore is configured to receive a spool member of the cocking device in a cocking position;

a riser assembly operatively attached to the front portion of the stock, the riser assembly including a riser operatively mounted on the front portion of the stock, a pair of bow limbs operatively attached to the riser, and a bow string operatively engaging each of the bow limbs;

a cover pivotally attached to the rear portion of the stock, wherein the cover pivots between a closed position and an open position, wherein in the closed position the cover prevents access to the bore;

a control attached to the rear portion of the stock, wherein actuation of the control transfers the cover from the closed position into the open position.

13. The crossbow of claim 12, wherein the receptacle includes a recess in an outer surface of the stock, and wherein the crossbow further comprises a receptacle member at least partially disposed within the recess, the receptacle member including two or more expanding members separated by an equal number of longitudinal gaps, wherein an internal surface of each of the expanding members defines the central cavity.

14. The crossbow of claim 12, further comprising a catch member pivotally mounted within the rear portion of the stock, the catch member operatively engaging the control, wherein the cover includes a latch engaging the catch member in the closed position, and wherein actuation of the control releases the latch from the catch member to transfer the cover from the closed position into the open position.

15. The crossbow of claim 14, wherein the catch member includes a first end, a second end, and a pivot point between the first and second ends, wherein the catch member rotates about the pivot point, wherein an inner end of the control engages the first end of the catch member and the second end of the catch member engages the latch in the closed position.

16. The crossbow of claim 15, wherein the second end of the catch member includes a shoulder, and wherein the latch includes a reciprocal shoulder engaging the shoulder of the second end of the catch member in the closed position.

17. A crossbow with an integrated cocking device, comprising:

a stock extending from a front portion to a rear portion, the stock including a bore through the rear portion and a receptacle in a first side surface of the stock between the front portion and the rear portion, wherein the receptacle includes a central cavity;

a riser assembly operatively attached to the front portion of the stock, the riser assembly including a riser operatively mounted on the front portion of the stock, a pair of bow limbs operatively attached to the riser, and a bow string operatively engaging each of the bow limbs;

a cover pivotally attached to the rear portion of the stock, wherein the cover pivots between a closed position and an open position, wherein in the closed position the cover prevents access to the bore;

a control attached to the rear portion of the stock, wherein actuation of the control transfers the cover from the closed position into the open position;

a hook member including a hook surface and a cord spool surface enclosing a cord aperture, the hook surface engaging the bow string in a cocking position, wherein a portion of the hook member is disposed in the central cavity of the receptacle of the stock in a storage position;

a spool member disposed through the bore of the stock in a cocking position;

a cord disposed about an outer surface of the spool member and extending through the cord aperture of the hook member in the cocking position.

18. The crossbow of claim 17, wherein the hook member further includes a plug, wherein a distal end of the plug is detachably secured in the central cavity of the receptacle of the stock in the storage position.

19. The crossbow of claim 17, wherein the cord engages the cord spool surface of the hook member in the cocking position.

20. The crossbow of claim 17, further comprising a second hook member, the second hook member including a hook surface, a cord spool surface enclosing a cord aperture, and a plug, wherein the hook surface engages the bow string in the cocking position, wherein a distal end of the plug is detachably secured in the central cavity of the receptacle of the stock in the storage position.

21. The crossbow of claim 17, further comprising a handle configured to detachably connect to an end of the spool member in the cocking position with the cover in the open position for rotation of the spool member to wind the cord and pull the hook member toward the rear portion of the stock to cock the bow string.

22. The crossbow of claim 21, further comprising a handle receptacle on the stock configured to detachably secure the handle in the storage position.

23. A method of using a crossbow, comprising the steps of:

a) providing a crossbow comprising: a stock extending from a front portion to a rear portion, the stock including a bore through the rear portion and a receptacle in a first side surface of the stock between the front portion and the rear portion, wherein the receptacle includes a central cavity; a riser assembly operatively attached to the front portion of the stock, the riser assembly including a riser operatively mounted on the front portion of the stock, a pair of bow limbs operatively attached to the riser, and a bow string operatively engaging each of the bow limbs; a cover pivotally attached to the rear portion of the stock, wherein the cover pivots between a closed position and an open position, wherein in the closed position the cover prevents access to the bore; and a control attached to the rear portion of the stock, wherein actuation of the control transfers the cover from the closed position into the open position;

b) securing a hook member of a cocking device to the receptacle in the stock to store the hook member;

c) positioning a spool member of the cocking device through the bore in the stock; and d) placing the cover of the stock in the closed position to prevent access to the spool member.

24. The method of claim 23, wherein step (b) further comprises inserting a plug of the hook member into the central cavity of the receptacle.

25. The method of claim 23, wherein the crossbow further comprises a handle receptacle on the rear portion of the stock, and wherein the method further comprises the step of:

e) securing a handle of the cocking device to the handle receptacle.

26. The method of claim 23, further comprising the steps of:

f) actuating the control of the stock to place the cover in the open position;

g) attaching a handle of the cocking device to the spool member;

h) detaching the hook member of the cocking device from the receptacle, and engaging the bow string with the hook member;

i) rotating the spool member with a rotation of the handle to draw the hook member in a direction toward the rear portion of the stock to cock the crossbow.

* * * * *